United States Patent [19]

Burns

[11] 4,135,068

[45] Jan. 16, 1979

[54] DEAD MAN SAFETY ASSEMBLY

[75] Inventor: Albert L. Burns, Houston, Tex.

[73] Assignee: Bowen Tools, Inc., Houston, Tex.

[21] Appl. No.: 722,742

[22] Filed: Sep. 13, 1976

[51] Int. Cl.[2] ..... H01H 9/06; B24B 49/00

[52] U.S. Cl. ..... 200/61.85; 51/436; 200/157; 200/318; 200/334

[58] Field of Search ..... 51/415, 427, 436, 438; 200/61.85, 157, 318, 321–325, 61.87; 123/198 D, 198 DC

[56] References Cited

U.S. PATENT DOCUMENTS

| | | | |
|---|---|---|---|
| 3,688,599 | 9/1972 | St. Germain | 200/61.85 X |
| 3,823,291 | 7/1974 | Milcoy | 200/318 X |
| 3,834,082 | 9/1974 | Grudzinski | 51/436 |
| 3,845,847 | 11/1974 | Camp | 123/198 DC X |
| 3,849,620 | 11/1974 | Melisz | 200/157 |
| 3,971,906 | 7/1976 | Suhrbacker | 200/321 X |

*Primary Examiner*—James R. Scott

[57] ABSTRACT

A new and improved dead man safety assembly having an activator lever mounted for movement from an operable position to an inactive position and a safety trigger mechanism coacting with the activator lever for preventing unintentional movement of the activator lever to the operable position. The control mechanism activated by the activator lever may be fluidic or electrical. The instant special application of the dead man safety assembly is related to control of hand-held abrasive hose and nozzle structures.

14 Claims, 11 Drawing Figures

A
50b
50a
C
60c
50c
60d
54a
34
50d
L
50
50e
86
60
60a
60d
90
68a'
58b
52
32
54
68b
58
58c
58a
T

A
C
80
S
70c
R
70b
70a
50b
80a
50a
50f
80c
50c
86
52
82
80d
60
50d
L
86a
86b
80b
84
50e
30k
T
30'
90
30c
B
68c
30i
68a
68b
R
60d
60c
32
34
16

R
C
S
50b
30f
50a
A
86
52
60
60d
50c
90
50d
L
94
50e
30k
30l
30c
32
30'
B
30i
68
R
58
68b
T
34

DEAD MAN SAFETY ASSEMBLY

BACKGROUND OF THE INVENTION

The field of this invention is dead man safety assemblies, particularly of the type used for remotely operating a control mechanism.

In the interest of safety, typically a control valve can be of a "dead man" type, wherein the manually operative mechanism in the remote control valve is biased in a manner such that in order to be operable, the operator must maintain the mechanism in a certain position. Upon the release of the mechanism, it typically is designed to return to its "off" position. United States Pat. No. 3,543,444 and British Pat. No. 1,394,483 disclose electrically operative control valves while U.S. Pat. Nos. 3,834,082; 3,557,498; and 3,201,901 disclose fluid-actuated control valves. Other types of remote control valves include those having internal valving adjacent the control thereof as shown in U.S. Pat. Nos. 3,618,263 and 2,641,087. In U.S. Pat. No. 2,641,087, a pinch-type control valve adjacent a blast hose nozzle is utilized for controlling fluid flow therethrough and having a trigger-actuated release for opening such a remote control valve.

While a number of these references disclose handles or protective coverings which purportedly are to help prevent inadvertent actuation of the control valve, as shown in U.S. Pat. Nos. 3,834,082; 3,557,498; 3,543,444, or are of a bleeder-type valve construction as manufactured by the Sanstrom Corporation or by Clemco-Clementine, Ltd. under the "Recova-Lok" trademark or as in U.S. Pat. No. 3,201,901, so far as known, none provides a positive safety locking member that must be intentionally moved by the operator prior to making such a control valve operable. Further, as far as is known, none of the prior art discloses structure that automatically deactivates the control valve as well as requires positive, user-actuation of a safety mechanism prior to reuse of the remote control valve after such a control valve is initially released.

SUMMARY OF THE INVENTION

The present invention relates to a new and improved dead man safety assembly having an activator lever mounted for movement from an operable position to an inactive position and a safety trigger mechanism coacting with the activator lever for preventing unintentional movement of the activator lever to the operable position.

DESCRIPTION OF THE PREFERRED EMBODIMENT

Figure 1:
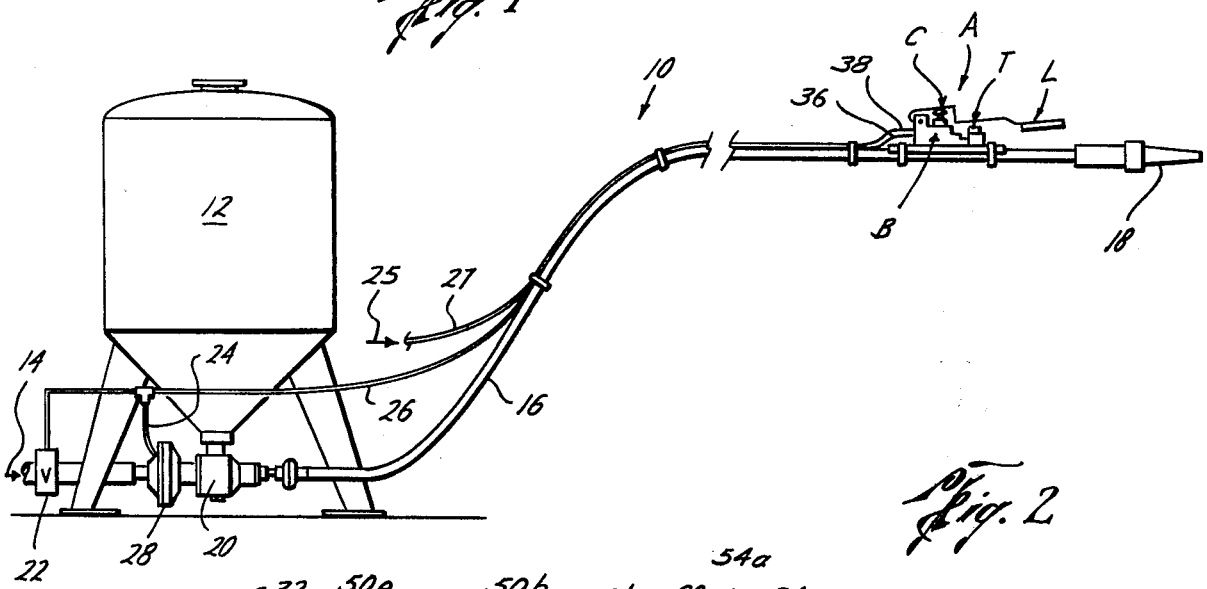
FIG. 1 is a schematic representation of an abrasive blasting system using the dead man safety assembly of the present invention.
Figure 2:
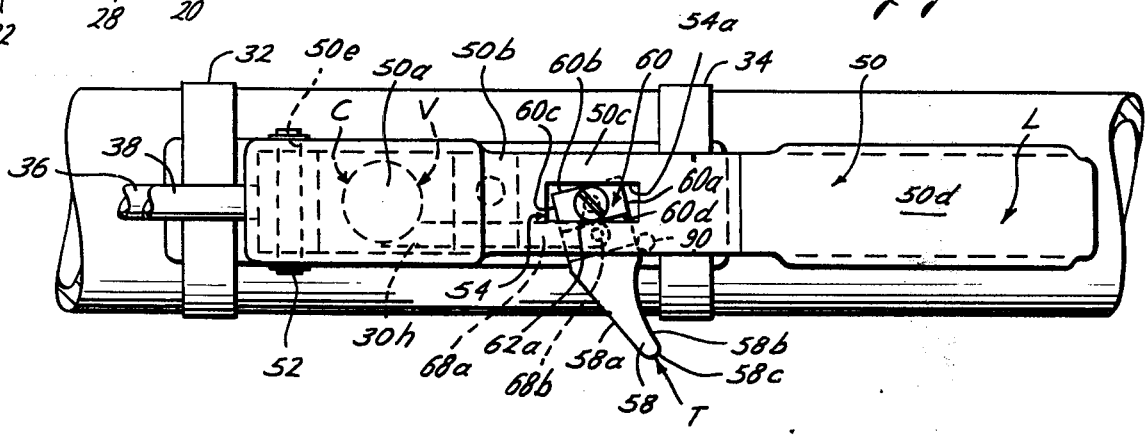
FIG. 2 is a plan view of one form of the dead man safety assembly of the present invention showing the safety trigger means in the normally, misaligned position.

Referring to the drawings, the letter A designates the dead man safety assembly of the preferred embodiment of this invention. The dead man safety assembly A includes an activator body B, a control means C, an activator lever L and safety trigger means T. Unless otherwise noted, preferably all the components of this invention are of steel or other suitable high-strength material capable of taking high stresses and strains as well as abuse without failure thereof.

The dead man safety assembly A of the present invention is generally a type of remote control valve wherein the manually operative mechanism in the remote control valve is biased in such a manner that in order to operate the control valve, the operator must maintain the mechanism in a certain position, and upon the release thereof, it returns to its off position in the interest of safety. Such a dead man safety assembly A may be used with a number of various types of applications. However, for the purposes of disclosure, the dead man safety assembly A of the present invention will be described as used with an abrasive blasting system 10 (FIG. 1) which is commonly utilized to clean or otherwise treat surfaces of building stone, brick work, metal castings, etc. Such an abrasive blasting system 10 typically includes a large pressurized tank 12 for holding abrasive particles such as sand, glass beads or the like, a source of high pressure fluid, such as air, entering the system in the direction of arrow 14, a high pressure abrasive hose 16 terminating in a nozzle 18, a control valve 20 for providing the abrasive into the abrasive hose 16 such that the particles and the high pressure fluid form a blastant stream which can be directed by the nozzle 18 at the article to be treated. Typically, the abrasive hose 16 may be quite long to enable the operator to get into places too small for the pressurized tank 12 to fit into or to enable the operator to cover large working areas without requiring the constant movement of the pressurized tank 12.

In order to permit a single operator to control the operation of the abrasive blasting system 10, it is desired that the dead man safety assembly A of the present invention be connected to the abrasive hose 16 for controlling the control valve 20. The control valve 20 connects the source of air pressure entering in the direction of arrow 14 to the pressurized tank 12 for feeding abrasive from the pressurized tank 12 into control valve 20 for providing abrasive particles under high fluid pressure into the abrasive hose 16 to effectuate blasting. The dead man safety assembly A of the present invention when moved to a predetermined position as described more fully hereinbelow, effects the energization of control valve 20 thereby opening the same for enabling blasting to commence. The dead man safety assembly A also discontinues the blasting process by causing the control valve 20 in the abrasive blasting system 10 to close when the dead man safety assembly A is returned to its non-blasting position.

Figure 3:
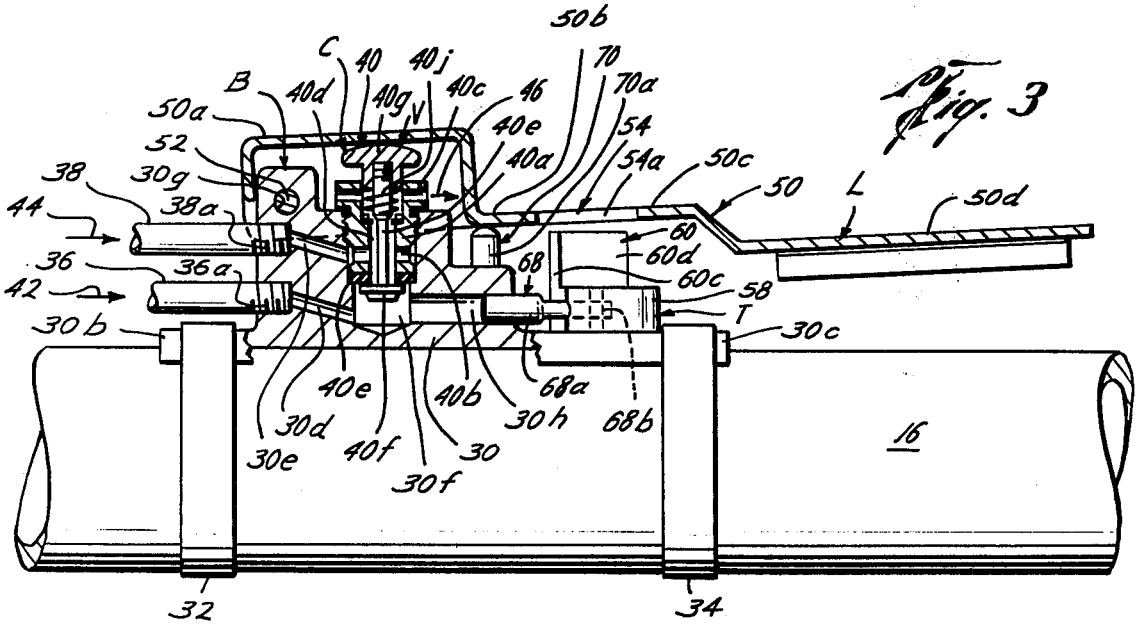
FIG. 3 is an elevational view, partly in section, of the dead man safety assembly of FIG. 2.
Figure 4:
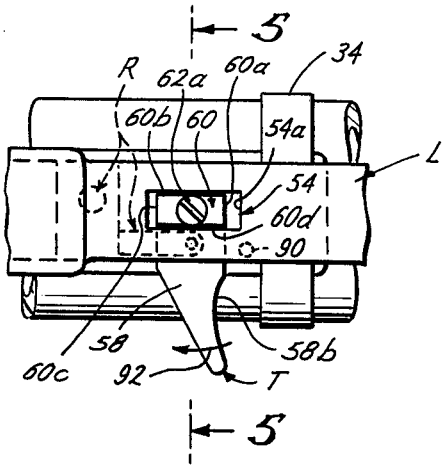
FIG. 4 is a plan view of the dead man safety assembly of FIG. 2 with the safety trigger means in an aligned position.
Figure 5:
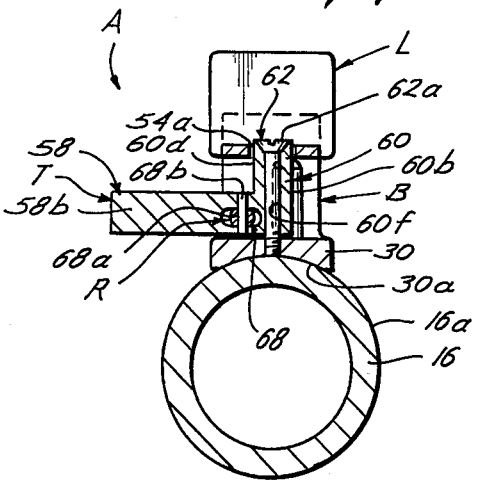
FIG. 5 is a sectional end view of the dead man safety assembly of the present invention, taken along the lines 5—5 of FIG. 4.
Figure 6:
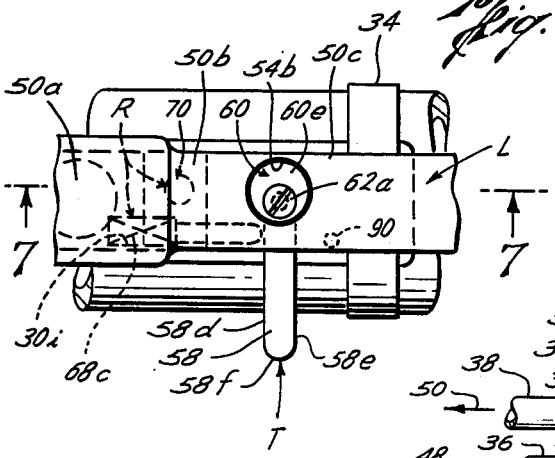
FIG. 6 is a plan view of an alternate embodiment of the safety trigger means of the dead man safety assembly of the present invention, with the safety trigger means in an aligned position.
Figure 7:
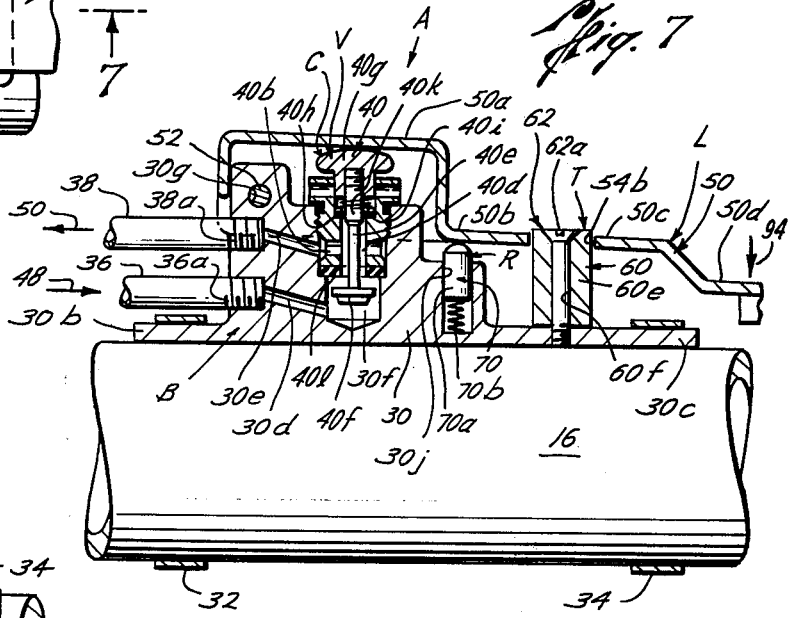
FIG. 7 is an elevational view, partly in section, of the dead man safety assembly of the present invention, taken along the lines 7—7 of FIG. 6, with the safety trigger means in an aligned position and the activator lever operatively engaging the control means.

Referring to FIGS. 2–8 which detail one form of the dead man safety assembly A of the present invention, the dead man safety assembly A includes an activator body B. The activator body B of one form of the present invention is shown in FIGS. 3, 5 and 7 includes body 30 which may be adapted to be mounted on the abrasive hose 16. As such, the body 30 is formed having a lower arcuate surface 30*a* (FIG. 5) which conforms substantially to the exterior surface 16*a* of abrasive hose 16 such that lower arcuate surface 30*a* substantially engages exterior surface 16*a*. The body 30 may be removably mounted with the abrasive hose 16 by mounting bands 32, 34 engaging the exterior surface 16*a* of abrasive hose 16 and mounting flanges 30*b*, 30*c* of body 30, respectively.

The body 30 is formed having an inlet chamber 30*d*, an outlet chamber 30*e* and a valve chamber 30*f* formed therein. Valve chamber 30*f* is in communication with inlet chamber 30*d* and outlet chamber 30*e* and further is adapted to receive control means C such as valve V. Inlet chamber 30*d* is adapted to be connected to inlet line 36 and outlet chamber 30*e* is adapted to be connected with outlet line 38, with lines 36, 38 preferably being threadedly mounted with the body 30 adjacent threads 36*a*, 38*a*, respectively.

Control means C is mounted with the activator body B for movement from a non-operative position as shown in FIG. 3 to an operative position as shown in FIG. 7. The control means C includes a valve V such as fluid-actuated valve 40 adapted to be mounted in the valve chamber 30*f* of the body 30. The fluid-actuated valve 40 is preferably of a "three-way" configuration. As shown in FIGS. 3 and 7, the fluid-actuated valve 40 includes a valve body 40*a* preferably threadedly mounted with valve chamber 30*f*. Horizontal passageways 40*b*, 40*c* and vertical passageway 40*d* in communication with passageways 40*b*, 40*c* are formed in the valve body 40*a*. Vertical passageway 40*d* is adapted to receive valve stem 40*e* having valve seat 40*f* adjacent the lower end thereof and actuator button 40*g* adjacent the upper end thereof. Preferably, the vertical passageway 40*d* is formed having a stepped portion 40*h* for receiving a seal 40*i* therewith and further providing a base for locating spring 40*j* about valve stem 40*e* therebetween the stepped portion 40*h* and the activator button 40*g*, with the spring 40*j* normally urging the fluid-actuated valve 40 into a closed position as shown in FIG. 3. The valve stem 40*e* includes an enlarged portion 40*k* adjacent the activator button 40*g* being of substantially the same diameter as the opening in seal 40*i*.

As shown in FIG. 3, the fluid-actuated valve 40 is in a non-operative position with valve seat 40*f* abutting lower surface 40*l* of valve body 40*a*. The valve seat 40*f* remains in this abutting position due to the resilient urging of spring 40*j* disposed therebetween stepped portion 40*h* and the actuator button 40*g*. In such non-operative position, fluid entering in the direction of arrow 42 through inlet line 36 flows through inlet chamber 30*d* into valve chamber 30*f* and is trapped therein. Fluid flowing in the direction of arrow 44 into outlet line 38 through outlet chamber 30*e* flows into passageways 40*b*, 40*d* and is vented outwardly therefrom valve body 40*a* through passageway 40*c* in the direction of arrow 46. This provides an atmospheric "bleeder" function for the fluid-actuated valve 40 while in the non-operative position.

When the actuator button 40*g* is depressed, as described more fully hereinbelow, the valve seat 40*f* moves from contact with the lower surface 40*l* of the valve body 40*a*. Simultaneously, the enlarged portion 40*k* of valve stem 40*e* engages seal 40*i* as the actuator button 40*g* blocks horizontal passageway 40*c* preventing any fluid flow outwardly therefrom. Thus, as shown in FIG. 7, fluid flowing in the direction of arrow 48 flows through inlet line 36, inlet chamber 30*d*, thereinto valve chamber 30*f*, therethrough vertical passageway 40*d*, outwardly through passageway 40*b*, outlet chamber 30*e* and outlet line 38 in the direction of arrow 50, with no atmospheric venting through passageway 40*c*.

The dead man safety assembly A of the present invention further includes an activator lever L movably mounted with the activator body B and operably engageable with the control means C. The activator lever L includes lever 50 which is preferably formed having a control means portion 50*a*, a return means portion 50*b*, a trigger receiving portion 50*c*, and an operator engaging portion 50*d*. Openings 50*e* are formed with side portions 50*f* (FIGS. 10, 11) with the openings 50*e* being used to preferably pivotally mount the lever 50 with the body 30 by means of pin 52 extending through such openings 50*e* and opening 30*g* formed in body member 30 for preferably pivotally mounting the activator lever L with the activator body B.

Figure 8:
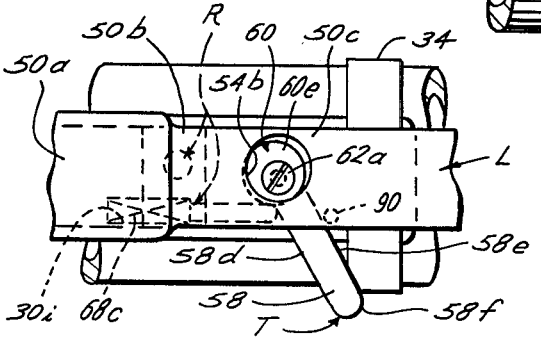
FIG. 8 is a plan view of the alternate embodiment of the safety trigger means of FIG. 6, with the safety trigger means being in the normally misaligned position.

The dead man safety assembly A of the present invention further includes safety trigger means T which coacts with the activator lever L. The safety trigger means T includes a safety trigger 58 having an upstanding portion 60 formed therewith. Preferably, the safety trigger 58 is formed having a flat surface 58*a* adjoining curved surface 58*b* at end portion 58*c* (FIGS. 2, 9) or alternatively, may be formed having parallel surfaces 58*d*, 58*e* adjoined at end portion 58*f* (FIGS. 6, 8). The upstanding portion 60 is preferably of a rectangular configuration (FIGS. 2, 4, 9) having side portions 60*a*, 60*b*, 60*c*, 60*d*. Alternatively, the upstanding portion 60 may be of a cylindrical configuration 60*e* as shown in FIGS. 6–8. Preferably, the safety trigger means T is movably mounted with the activator body B by a suitable fastener 62 such as bolt or screw 62*a* capable of extending through opening 60*f* (FIGS. 5, 7) formed in the upstanding portion 60. It should be noted that opening 60*f* is substantially, centrally formed in the upstanding portion 60 of the rectangular configuration whereas the opening 60*f* as formed with the upstanding portion 60*e* of a cylindrical configuration is offset from the central portion thereof as will be described more fully hereinbelow.

The dead man safety assembly A further includes returning means R. The returning means R includes bias means 68 and support means 70. The bias means 68 is preferably mounted with the activator body B for engaging the safety trigger means T for automatically biasing the safety trigger means T. The bias means 68 includes a trigger pin 68a (FIG. 3) adapted to be pivotally connected to the safety trigger means T by link 68b. The trigger pin 68a is adapted to be movably mounted with the activator body B.

As shown in FIG. 3, the trigger pin 68a is disposed in trigger pin chamber 30h which is in communication with valve chamber 30f. When the fluid-actuated valve 40 is closed, as shown in FIG. 3, fluid pressure in valve chamber 30f is communicated to the trigger pin 68a through trigger pin chamber 30h for urging the same outwardly.

Alternatively, the trigger pin 68a may be mounted in trigger pin chamber 30i (FIGS. 6, 8, 10, 11) formed in body 30 having a suitable spring 68c in abutting relation to the trigger pin 68a and the end wall of the trigger pin chamber 30i for resiliently mounting the trigger pin 68a for movement towards the safety trigger means T.

Figure 9:
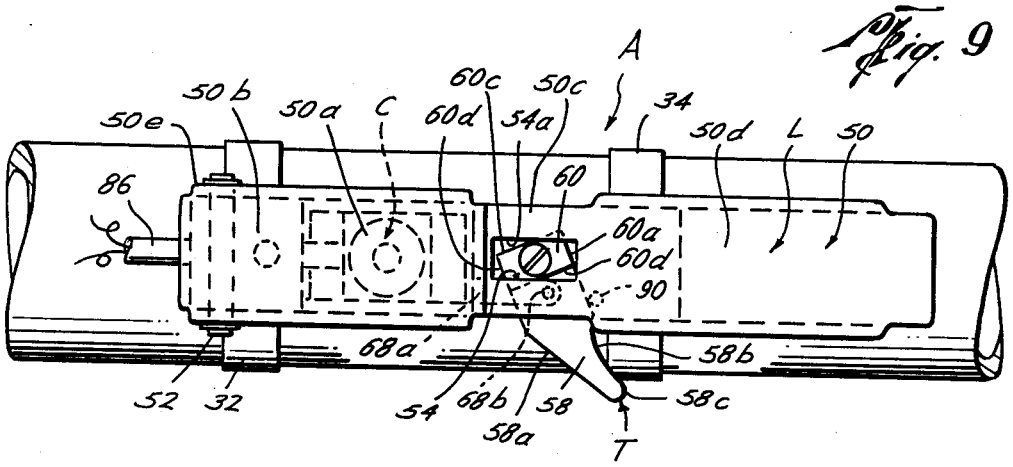
FIG. 9 is a plan view of a second form of the dead man safety assembly of the present invention, with the safety trigger means being in a misaligned position.
Figure 10:
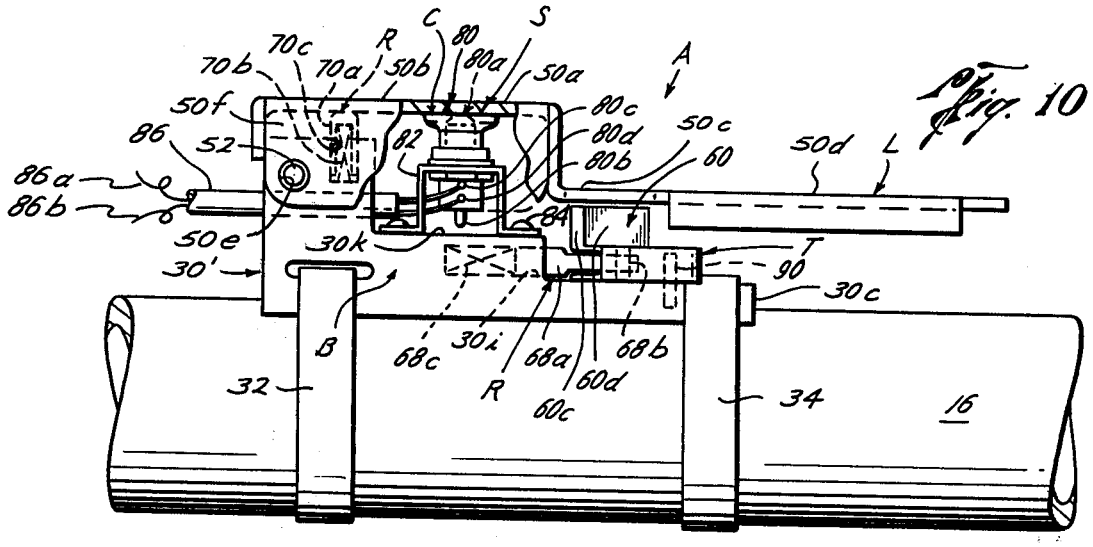
FIG. 10 is an elevational view, partly in section, of the dead man safety assembly of FIG. 9; and, FIG. 11 is an elevational view of the dead man safety assembly of FIG. 9, with the safety trigger means in an aligned position and the activator lever operatively engaging the control means.
Figure 11:
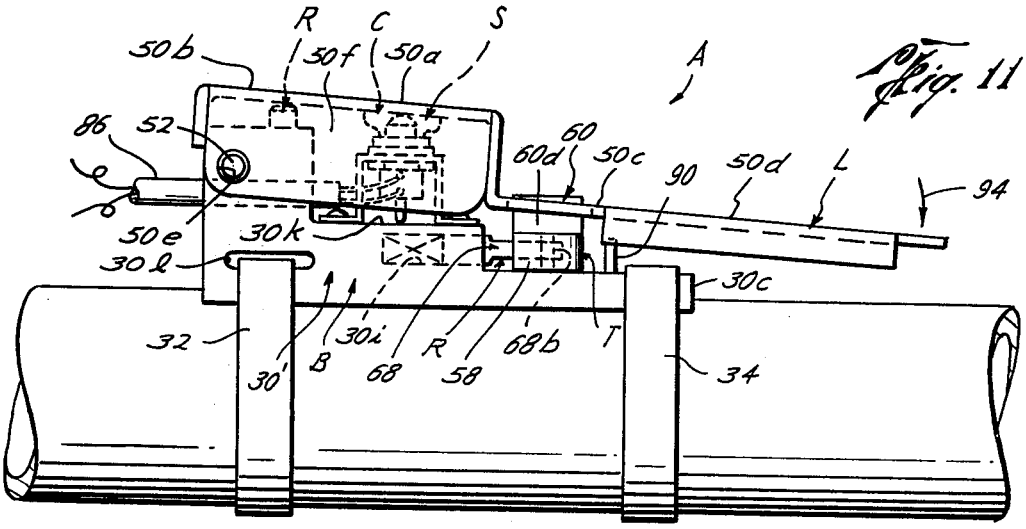

The returning means R further includes support means 70 mounted with the activator body B for engagement with the activator lever L. The support means 70 includes a support pin 70a and a spring 70b adapted to be disposed in support pin chamber 30j formed in body member 30. The support means 70 may be mounted with the activator body B adjacent the bias means 68 as shown in FIGS. 2, 3, 4, 6, 7, 8 or alternatively may be mounted with the activator body B adjacent the pin 52 used for pivotally mounting the activator lever L with the activator body B as shown in FIGS. 9-11. As shown in FIG. 10, the support pin 70a may be formed having a hollow portion 70c therein and adapted to receive spring 70b therein for resiliently urging the support pin 70a upwardly.

As shown in FIGS. 9–11, the dead man safety assembly A of the present invention may alternatively include a control means C being a switch S rather than a valve V. Preferably, the activator body B of this embodiment is similar to that of the first embodiment, with the exception of the following changes. The activator body B of the second embodiment has a slot 301 formed with body 30' for mountably receiving mounting band 32, while mounting flange 30c receives mounting band 34. Rather than having chambers 30d, 30e, 30f, 30h, the body 30' is formed having switch receiving surface 30k (FIGS. 10,11).

The switch S which includes an electrically actuated switch 80, is adapted to be mounted with the body 30' on the switch-receiving surface 30k by switch bracket 82 being suitably attached thereto by fasteners 84. Switch bracket 82 is formed having a suitable opening (not numbered) therein for receiving switch 80. Electrically-actuated switch 80 includes switch actuator 80a and switch stem 80b having electrical contacts (not shown) therewith for contacting contacts 80c, 80d attached to electrical leads 86a, 86b of electrical conduit 86, respectively. As illustrated in FIG. 10, the switch 80 is electrically open and in a non-operative position, whereas as shown in FIG. 11, the switch 80 is electrically closed and in an operative position. It should be noted that in the operative position, the lower end of switch stem 80b contacts the switch-receiving surface 30k which limits the movement of switch stem 80b insuring alignment of the contacts (not shown) on the switch stem 80b with those contacts 80c, 80d for a proper, electrically closed connection therebetween, in such operative position.

The lever 50 is preferably formed having a trigger opening 54 formed adjacent the trigger receiving portion 50c of lever 50. As shown in FIGS. 2, 3, 4, 9–11, the trigger opening 54a is of a substantially rectangular configuration and of slightly larger dimension than the rectangularly formed upstanding portion 60. Alternatively, the trigger opening 54b of substantially a circular configuration is of slightly larger diameter than the cylindrical upstanding portion 60e and adapted to receive the same when properly positioned as described more fully hereinbelow.

In the use or operation of the dead man safety assembly A of the present invention, the activator lever L is normally in a first position as shown in FIGS. 2, 3, 8, 9, 10 wherein the control means C is in a non-operative position. As such, the valve V is closed (FIG. 3) or the switch S is electrically open (FIG. 10). The activator lever L is movable in the direction of arrow 94 from the first position to a second position wherein the control means C is in an operative position such as the valve V in FIG. 7 or the switch S in FIG. 11. However, safety trigger means T coacting with the activator lever L typically prevents movement of the activator level L from the first position to the second position. The safety trigger means T is in a normally misaligned position as shown in FIGS. 2, 3, 8, 9, 10 wherein unintentional movement of the activator level L from the first position to the second position is prevented. Upon movement of the safety trigger means T to an aligned position as shown in FIGS. 4, 5, 6, 7, and 11, the activator lever L is permitted to move from the first position to the second position for actuating the control means C.

In the misaligned position, the upstanding portion 60 of the safety trigger means T is misaligned with the trigger opening 54 formed in the activator lever L. Such misalignment of the safety trigger means T with the activator lever L being in the first position is insured by urging of the bias means 68 on the safety trigger means T. By means of fluid pressure (FIG. 3) or spring action (FIGS. 6, 8, 10, 11), the trigger pin 68a urges the safety trigger 58 into the misaligned position as limited by stop 90 mounted with the activator body B. In such misaligned position, the upstanding portion 60 of a rectangular configuration does not align with the trigger opening 54a in the lever 50 nor does the cylindrical upstanding portion 60e align with the circular trigger opening 54b thus preventing movement of the activator lever L from the first position to the second position. Further, the support means 70 resiliently urges the activator lever L upwardly to further prevent movement of the activator lever L downwardly from the first position as does the internal return spring arrangement within the control means C such as spring 40j of fluid-actuated valve 40.

To accomplish movement of the activator lever L from the first position to the second position in the direction of arrow 94, it is necessary that the safety trigger means T be rotated from the misaligned position to the aligned position against the biasing force of the bias means 68. Movement to the aligned position as shown in FIG. 4 is accomplished by the operator moving the safety trigger 58 in the direction of arrow 92. Curved surface 58b is particularly well suited for being engaged by the hands of the operator without slippage therefrom due to the arcuate configuration thereof. Similarly, engagement of the safety trigger 58 of FIG. 8 and movement thereof to the position as shown in FIG. 6 results in movement of the upstanding portion 60e from a misaligned position to an aligned position. Most notably, the safety trigger 58 of FIG. 8 is eccentrically mounted with the activator body B due to the offset of the opening 60*f* formed in upstanding portion 60*e* for receiving fastener 62 therethrough for attachment to the activator body B. Preferably, the safety trigger means T is adapted for rotatable movement from the normally misaligned position to the aligned position.

With the safety trigger means T in the aligned position, the activator lever L is movable in the direction of arrow 94 (FIGS. 7, 11) from the first position wherein the control means C is in the non-operative position to the second position wherein the control means is in an operative position. With the control means C in the operative position, any desired work may be performed. As used with the example of FIG. 1 in the abrasive blasting system 10, actuation of the control means C to an operative position results in the flow of abrasive particles from the pressurized tank 12 into control valve 20 wherein high pressure fluid in the direction of arrow 14 is mixed with the abrasive particles and directed through abrasive hose 16 to nozzle 18 and outwardly therefrom for appropriate abrasive blasting use.

When the valve V of control means C of the dead man safety assembly A of the present invention is used with the abrasive blasting system 10 and the control means C is in the non-operative position, high pressure fluid entering in the direction of arrow 14 is directed by metering valve 22 into lines 24, 26 and thereinto inlet line 36. However, inasmuch as there is no fluid flow therethrough valve V, lines 24, 26, 36 are pressurized with such high pressure fluid. The pressure of the fluid in line 24 acts against a fluid-actuated diaphragm 28 which secures the control valve 20 in the closed position. Simultaneously, fluid entering in the direction of arrow 25 through line 27 into outlet line 38 is atmospherically vented as described hereinabove. Upon movement of the safety trigger means T from the misaligned position to the aligned position in the direction of arrow 92 and movement of the activator lever L from the first position to the second position in the direction of arrow 94, the control means C is activated allowing fluid flow to inlet line 36, therethrough valve chamber 30*f* formed in body 30 and outwardly therefrom through outlet line 38. Such action results in pressure drop across the diaphragm 28 and metering valve 22 resulting in the high pressure fluid flowing therethrough metering valve 22 and into control valve 20 with the fluid-actuated diaphragm 28 opening the control valve 20 to allow the flow of abrasive particles from the pressurized tank 12 thereinto control valve 20 mixing with the high pressure fluid for use in blasting operations thereof.

A similar system may be incorporated wherein the switch S may actuate an electrically-actuated solenoid (not shown) which in turn actuates a corresponding metering valve 22' and control valve 20 for regulating high pressure fluid and the mixing thereof with abrasive particles stored within tank 12.

Should the operator unintentionally drop the dead man safety assembly A of the present invention or intentionally release the same, the support means 70 will urge the activator lever L upwardly from a position wherein the upstanding portion 60 no longer engages the trigger opening 54. Bias means 68 thereafter rotates the safety trigger means T to its normally, misaligned position wherein movement of the activator lever L from the first position to the second position is prevented. Accordingly, the dead man safety assembly A of the present invention may not operatively engage the control means C until the safety trigger means T is again rotated in the direction of arrow 92 from the misaligned position to the aligned position to allow depression of the activator lever L from the first position to the second position for movement of the control means C from the non-operative position to the operative position. As a result thereof, should the dead man safety assembly A be dropped from the operator's hands, the returning means R will automatically return the dead man safety assembly A to its dormant position wherein the control means C is in its non-operative position and the safety trigger means T is in its normally misaligned position. Even if the unit falls and lands on the activator lever L, the safety trigger means T will prevent actuation of the control means C unintentionally.

A further feature of the activator lever L relates to its protective covering about the control means C to prevent contamination thereof by the working environment. In particular, side portions 50*f* in conjunction with the control means portion 50*a* provide an effective housing about the fluid-actuated valve 40/electrically actuated switch 80 to prevent deterioration thereof due to ricocheting abrasive particles discharged by nozzle 18 when the dead man safety assembly A of the present invention is used with the abrasive blasting system 10.

Thus, the dead man safety assembly A of the present invention provides a safe, effective, durable, easy to use mechanism for preventing unintentional actuation of a system from a location remote therefrom.

The foregoing disclosure and description of the invention are illustrative and explanatory thereof, and various changes in the size, shape and materials as well as in the details of the illustrated construction may be made without departing from the spirit of the invention.

I claim:

1. A dead man safety assembly, comprising:

an activator body;

control means mounted with said activator body and movable from a non-operative position to an operative position;

an activator lever pivotally mounted with and externally of said activator body along the longitudinal axis thereof and operably engagable with said control means, said control means movable from a first position wherein said control means is in said non-operative position to a second position wherein said control means is in said operative position by pivotal movement of said activator lever with respect to said activator body for operatively engaging said control means; and, safety trigger means rotatively mounted with and externally of said activator body and coacting with said activator lever, and said safety trigger means being rotatable about an axis substantially perpendicular to the longitudinal axis of said activator body, said safety trigger means rotatable from a normally misaligned position relative to said activator lever wherein unintentional movement of said activator lever from said first position to said second position is prevented, to an aligned position wherein movement of said activator lever from said first position to said second position for actuating said control means is permitted.

2. The dead man safety assembly of claim 1, further including:

means mounted with said activator body for automatically returning said safety trigger means to said misaligned position upon a release of said activator lever by the operator.

3. The dead man safety assembly of claim 2, wherein said returning means further includes:

bias means mounted with said activator body for engaging said safety trigger means for automatically biasing said safety trigger means in said normally misaligned position upon release of said activator lever by the operator to prevent unintentional movement of said safety trigger means from said normally misaligned position to said aligned position.

4. The dead man safety assembly of claim 3, wherein said bias means includes:

a trigger pin pivotally connected to said safety trigger means and mounted with said activator body for movement along the longitudinal axis of said activator body for automatically biasing said safety trigger means in said normally misaligned position upon release of said activator lever by the operator.

5. The dead man safety assembly of claim 4, wherein: said trigger pin is fluid-actuated.

6. The dead man safety assembly of claim 4, wherein: said trigger pin is resiliently, spring-actuated.

7. The dead man safety assembly of claim 3, wherein said returning means further includes:

support means mounted with said activator body for engaging said activator lever to automatically support said activator lever in said first position upon release of said activator lever by the operator.

8. The dead man safety assembly of claim 7, wherein said support means further includes:

a support pin for engaging said activator lever and resiliently urging said activator lever into said first position upon release of said activator lever by the operator.

9. The dead man safety assembly of claim 1, wherein said safety trigger means includes:

a safety trigger having an upstanding portion adapted to be received in an opening formed in said activator lever, said safety trigger being rotatable from said normally misaligned position wherein said upstanding portion is in misalignment with said opening preventing said activator lever from moving said control means from said non-operative position to said operative position to said aligned position wherein said upstanding portion is aligned with said opening and adapted to be received therein for permitting said activator lever to move said control means from said non-operative position to said operative position.

10. The dead man safety assembly of claim 9, wherein:

said opening and said upstanding portion are of a substantially rectangular configuration.

11. The dead man safety assembly of claim 9, wherein:

said opening and said upstanding portion are of a substantially circular configuration.

12. The dead man safety assembly of claim 1, wherein said control means includes:

a fluid actuated valve which is closed to fluid flow therethrough when in said non-operative position and open to fluid flow therethrough when in said operative position.

13. The dead man safety assembly of claim 1, wherein said control means includes:

an electrically actuated switch which is electrically open when in said non-operative position and electrically closed in said operative position.

14. The dead man safety assembly of claim 1, wherein:

said activator lever has protection means therewith for protectively covering said control means to prevent damage thereto.

* * * * *